United States Patent [19]

Bear

[11] Patent Number: 4,804,025

[45] Date of Patent: Feb. 14, 1989

[54] CARRYING HARNESS FOR SURFBOARDS AND THE LIKE

[76] Inventor: Deborah A. Bear, 412 Halladay St., Seattle, Wash. 98109

[21] Appl. No.: 47,728

[22] Filed: May 7, 1987

[51] Int. Cl.[4] ..... A45F 3/14; A63C 11/02

[52] U.S. Cl. ..... 224/202; 224/917; 224/901; 224/264; 224/258; 297/147

[58] Field of Search ..... D3/36; 114/39.2, 343; 294/137, 146, 147, 149, 150, 152, 153, 154, 155, 156, 157, 158, 170; 280/814; 150/52 R; 441/74; 224/264, 917, 150, 191, 201, 202, 235, 236, 250, 251, 255, 257, 258, 901

[56] References Cited

U.S. PATENT DOCUMENTS

| | | | |
|---|---|---|---|
| 135,530 | 2/1973 | Dunham | 294/154 |
| 2,644,623 | 7/1953 | White | 224/205 |
| 3,327,914 | 6/1967 | Abram | 224/901 X |
| 3,377,007 | 4/1968 | Gaylor, Jr. | 224/205 |
| 3,799,227 | 3/1974 | Cantwell | 224/202 |
| 3,917,137 | 11/1975 | Wilkins | 294/147 |
| 4,002,277 | 1/1977 | Westerholm | 294/147 |
| 4,463,885 | 8/1984 | Ball et al. | 224/250 |
| 4,470,528 | 9/1984 | Dyess | 224/257 |
| 4,483,380 | 11/1984 | Beran | 150/52 R |
| 4,553,779 | 11/1985 | Shortridge | 294/147 |
| 4,674,787 | 6/1987 | DeVera | 294/147 |
| 4,724,989 | 2/1988 | Silberberg | 224/202 |

FOREIGN PATENT DOCUMENTS

| | | | |
|---|---|---|---|
| 1470362 | 2/1967 | France | 294/149 |
| 8102577 | 12/1982 | Netherlands | 224/202 |
| 8501194 | 3/1985 | PCT Int'l Appl. | 224/917 |

*Primary Examiner*—Henry J. Recla
*Assistant Examiner*—Ernest G. Cusick
*Attorney, Agent, or Firm*—Knobbe, Martens, Olson & Bear

[57] ABSTRACT

A device for carrying a sailboard, surfboard or the like, includes a spreader bar and a pair of slings supported therefrom. A fastener attaches each of the slings into an adjustable-sized loop to fit around the sail board. A strap supports the spreader bar from a user's shoulder and has an adjustable length for accommodating different-sized people.

15 Claims, 1 Drawing Sheet

Fig. 1
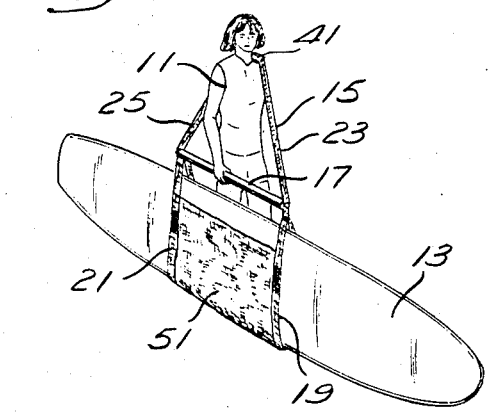
Fig. 2
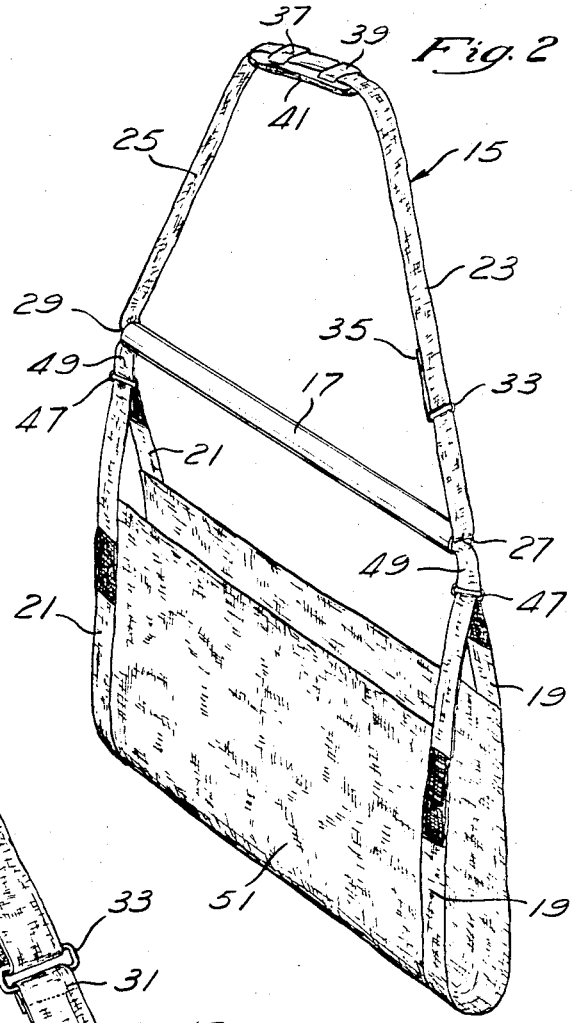
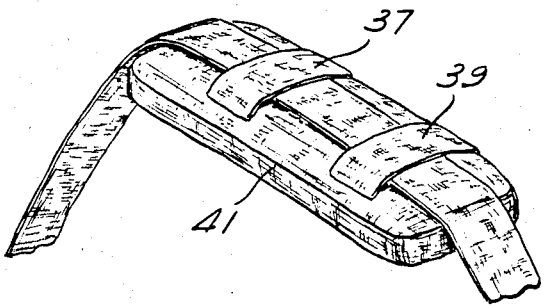
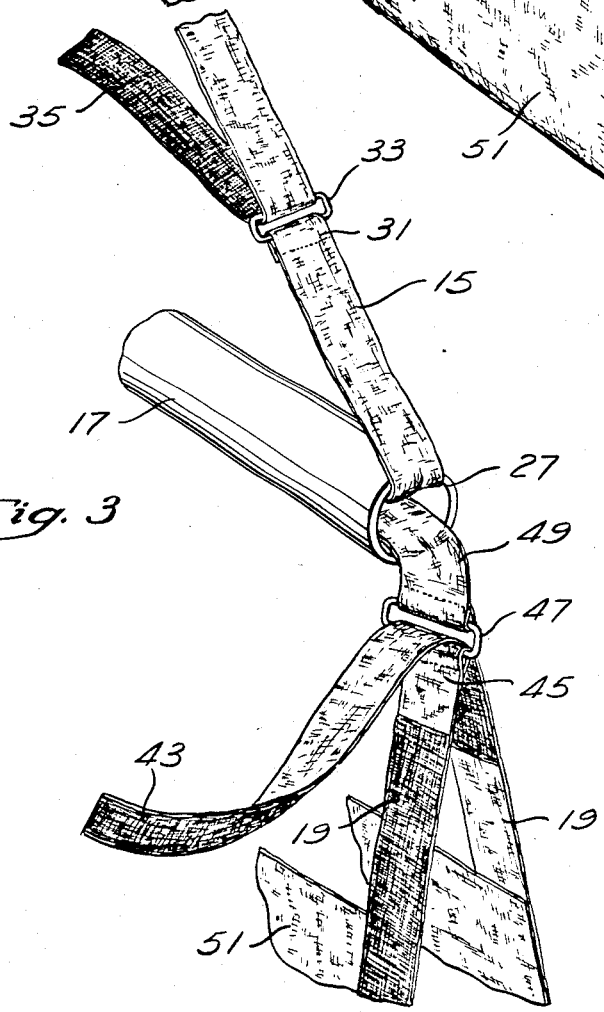
Fig. 3

CARRYING HARNESS FOR SURFBOARDS AND THE LIKE

BACKGROUND OF THE INVENTION

This invention relates to an apparatus for carrying a surfboard, sailboard or the like. More specifically, the invention provides a device which allows one person to conveniently transport such a board, as from their automobile to the water, without the help of another person.

Surfboards and sailboards are unwieldy to transport, and many are wide enough that it is difficult for a user to tuck the board under his/her arm so that it can be grasped by the hand for carrying. This, in many instances, prohibits transportation by a single person, especially a person who is slight in stature. Furthermore, many of these boards are heavy enough that carrying them with one hand beneath the board is fatiguing. Thus, many people are forced to hold the board across their body, grasping the board from beneath with both hands. This, of course, makes it impossible to carry any other articles, such as paddles, masts, etc. with the other hand. It also provides an unwieldy load, especially if the distance to be traveled is substantial.

Advantageously, the weight of the board should be born on the user's shoulder, since most people are capable of carrying substantially more weight from their shoulder without fatigue. One prior art device is marketed which is in the form of a net which envelopes the board from end-to-end, and includes a shoulder strap to support the net, and thus the board. The shoulder strap is attached at two separate points on the net, so that, when the net is stretched over the board, the shoulder strap will extend in the form of an inverted V, with the apex of the V resting on the shoulder of the user. The attachments of the strap ends to the net are thus positioned at some distance ahead and behind of the user. This arrangement makes the device somewhat comfortable to use, since the strap is held away from the user's body.

To provide this advantage, however, the device requires the user to wrap the net around the entire board, and especially over the board ends. This permits the board to stretch the net lengthwise along the board, and thus maintain the attachment points for the shoulder strap separated. It is inconvenient to wrap and unwrap the board from the net. Furthermore, the net must approximate the length of the board for the device to be used effectively. The device also requires the user to grasp the top of the board, or the netting along the top of the board, to direct and stabilize the load during portage. Grasping the top of the board itself is awkward, and grasping the net can be painful, since the slender strands of the netting can cut into one's hand. Furthermore, neither of these techniques permits the user to support a substantial portion of the weight of the board with his/her hand.

SUMMARY OF THE INVENTION

These difficulties associated with the prior art are alleviated with the device of the present invention. The apparatus disclosed herein permits the convenience of an inverted V-shaped shoulder strap, without relying on the board itself to maintain the arms of the V separated and away from the body of the user. Further, the device does not require an inconvenient wrapping of the entire length of the board in the device. The device also provides the user with a convenient handle for guiding the load, and for supporting a portion of the load with the user's hand.

Briefly, the invention includes a pair of slings which may be looped around the center of the board at two separated locations along the board's length. These slings include fasteners which permit the loops to be adjusted to snugly support boards of various sizes.

The slings are supported from a spreader bar which is sufficiently rigid to maintain the separation of the loops along the length of the board. This separate support of the board at two locations ahead and behind the board's center of gravity provides stability during portage.

The spreader bar is also attached to the ends of the inverted V strap which forms a shoulder sling. The rigidity of the bar keeps the arms of the V-shaped strap away from the user's body to permit comfortable use. Furthermore, the bar itself is conveniently grasped by the user to permit the user to guide the board as he/she walks, and to lift a part of the weight of the board with his/her hand. The length of the shoulder sling is adjustable so that users of different stature may conveniently adjust the height of the board, and the height of the bar itself, to permit convenient hand support.

Most advantageously, hook-and-loop fasteners are used for adjustment of the slings which loop around the board, and for adjustment of the shoulder sling. This type of fastener permits easy attachment and removal of the device from the board, and adjustment for different boards and users.

A web is attached to the slings which are looped around the board, to cradle the center of the board, and to make the device more organized for attachment to the board.

These and other advantages of the present invention are best understood through a reference to the drawings and the detailed description which follow.

BRIEF DESCRIPTION OF THE DRAWINGS

FIG. 1 is a perspective view of the apparatus of this invention in use, suspended from the shoulder of a person, and attached to a surfboard, sailboard or the like;

FIG. 2 is a perspective view of the invention, looped as it would be to carry a board, but with the board removed to facilitate a detailed description of the apparatus; and FIG. 3 is an enlarged, broken-away, perspective view of one end of the spreader bar of the present invention, showing the manner of attachment of the slings to this bar, and the use of fasteners to adjust the length of the slings.

DESCRIPTION OF THE PREFERRED EMBODIMENT

Referring initially to FIG. 1, the apparatus of this invention permits a single person 11 to conveniently transport a surfboard, sailboard or the like 13. As can be seen from the figure, this load is particularly unwieldy. Yet, with the aid of this apparatus, the person 11 can not only comfortably support the board 13 from one shoulder, but can also guide the board, as along a narrow walkway or the like.

Essentially, the apparatus includes a shoulder sling or strap 15, a spreader bar 17, and a pair of board-supporting loops or slings 19, 21. The shoulder sling 15 is attached in the preferred embodiment at the ends of the spreader bar 17, and passes over the user's shoulder to form an inverted V. The spreader bar 17 is long enough to hold the two arms of the V away from the body of the person 11, with the forward arm 23 extending away from the chest of the person 11, and the rearward arm 25 extending away from the back of the person 11.

As best shown in FIG. 2, the sling 15 is attached to the spreader bar 17 at attachment points 27 and 29. The inverted V form of the sling 15 is formed by maintaining the distance between the attachment points 27 and 29, along the length of the spreader bar 17, at least twelve inches. It has been found that a smaller separation makes the apparatus uncomfortable to use if the board 13 is carried a long distance. It is advantageous if the attachment points 27 and 29 are located at the opposite ends of the spreader bar 17 thereby being equidistant from the longitudinal center of the spreader bar 17.

The board-supporting loops 19,21 snugly surround the board 13, and are suspended from the spreader bar 17. The loops are attached to the spreader bar 17 at the same points 27 and 29. It has been found that the points of attachment of the loops 19,21 need not be at the same location on the spreader bar 17 as the points of attachment of the sling 15. However, it is advantageous that the loop-supporting points be separated by at least twelve inches and be equidistant from the longitudinal center of the spreader bar 17. This separation at the spreader bar 17 assures that the loops 19, 21, throughout their length, will stay separated as they pass around the board 13, thus providing stable support for the board 13.

While, in the preferred embodiment, both the shoulder sling 15 and the loops 19,21 are attached at points 27 and 29 at the ends of the spreader bar 17, such attachment is not required. Rather, the separations between attachment points specified above are significant. It is also advantageous to center the attachment points of the shoulder sling 15 with the attachment points of the loops 19, 21, so that the load is balanced from the shoulder of the user 11.

As is evident from FIG. 1, in addition to its function in separating the attachment points of the shoulder sling 15 and the loops 19, 21, the spreader bar 17 provides a convenient handle. The user 11 can grasp the spreader bar 17, not only to guide the board 13 during portage, but also to support a portion of the weight of the board 13. Often, a user will find the handle convenient to raise the front or rear of the board 13 to pass over obstacles or stairs. The spreader bar 17 is dimensioned to permit the user 11 to firmly grasp it, as would be impractical if the user 11 had to grasp the board 13 itself, or a slender web or rope.

Turning now to FIGS. 2 and 3, the details of construction of the apparatus may be examined. The shoulder sling 15 comprises a single one-hundred-and-two inch length of nylon webbing, two inches in width. One end 31 of the webbing is folded over a square D-ring and sewn to itself. The other end 35 is passed through the spreader bar 17, which comprises a thirty inch length of one-and-one-half inch plastic pipe, such as schedule 40 water pipe. After passing through the spreader bar 17, the end 35 is also passed through two loops 37,39 of a shoulder pad 41. Finally, the end 35 is passed through the square D-ring 33, and folded back on itself.

The end 35 of the sling 15 is provided with hook-and-loop fastening material. Specifically, the final twelve inches at the end 35 is covered, on one side, with two-inch-side hook material, while the next twenty-four inches is covered, on the same side, with two-inch-wide loop material. This arrangement permits the end 35 of the sling 15 to be passed through the square D-ring 33 folded onto itself, with an adjustable amount of the end 35 being passed through the ring 33. This permits the length of the sling 15 to be adjusted, and thus, in turn, the height of the spreader bar 17 in relation to the person 11.

The loops 37, 39 of the shoulder pad 41 are loose enough to permit the pad 41 to slide to the proper position to sit atop the user's shoulder, yet snug enough to stay in place on the sling 15 once adjusted. The pad 41 preferably comprises a three inch by ten inch sheet of three quarter inch foam sewn within a nylon pouch.

Each of the loops 19, 21 comprises seventy inch length of nylon webbing, two inches in width. One end 43 of each loop 19, 21 supports hook fastening material, two inches in width, extending throughout the final twelve inches of its length. The other end 45 of each loop 19, 21 is folded over a square D-ring 47 and sewn to itself. The final twenty four inches of this end 45 is covered with loop fastening material, so that the ends 43, 45 may be adjustably fastened together. This adjustability permits the loops 19, 21 to be passed snugly around the board 13.

The square D-rings 47 at the ends of the loops 19, 21, are attached to opposite ends of a support strap 49. This strap comprises a thirty-five inch length of two inch wide nylon webbing, folded over itself and the respective square D-ring 47 at each end, and sewn to itself. This strap passes through the spreader bar 17 to support the loops 19, 21.

A thirty-four inch open-weave by forty-four inch fabric pouch or web 51 is sewn, along two opposite sides, to the loops 19, 21. This pouch supports the surfboard, sailboard or the like 13 between the loops 19, 21, and keeps the loops 19, 21 arranged in their proper position as the apparatus is wrapped around the board 13. The pouch 51 preferably comprises cordura nylon fabric.

For use, the apparatus is first laid flat on the ground, and the board 13 is laid flat covering one half of the pouch 51. The other half of the pouch 51 is then folded over the board 13, and the ends 43 of the loops 19, 21 are passed through the square D-rings 47. The loops 19, 21 are pulled snug around the board 13, and the ends 43 are fastened to the ends 45 using the hook-and-loop fasteners.

The sling 15 is then adjusted to fit the person 11, and the pad 41 is placed on the person's shoulder, raising the board 13 off the ground for portage. This leaves the person's other hand free to carry paddles, masts, or the like, or such articles may be passed through the loops 19, 21 to be carried along side the board 13.

I claim:

1. Apparatus for facilitating human portage of a sailboard, surfboard or the like having ends, comprising:

a spreader bar having ends and a longitudinal center;

a pair of slings supported at first and second spaced locations on said spreader bar, said bar having sufficient rigidity to keep said first and second locations separated, along the length of said spreader bar, by a distance of at least twelve inches, during use of said apparatus;

a fastener attaching each of said slings into a loop, the size of which may be adjusted to fit around said sailboard, surfboard or the like, said loops separated from one another, along the length of said spreader bar by a distance substantially equal to the distance between said first and second locations, said spreader bar maintaining separation between said loops, when said apparatus is in use, along the length of said sailboard, surfboard or the like, by means of the separation between said first and second locations, without attachment between said loops and said ends of said sailboard, surfboard or the like;

a strap, supporting said spreader bar at third and fourth spaced locations, said third and fourth locations separated, along the length of said spreader bar, by a distance of at least twelve inches, said strap forming a shoulder harness having an adjustable length for accommodating different-sized people, the length of said strap being greater than the distance between said spreader bar and the top of said sailboard, surfboard or the like to thereby permit said spreader bar to be used as a handle while said strap is used as a shoulder harness.

2. Apparatus as defined in claim 1 wherein said first and third locations are at the same location along the length of said spreader bar.

3. Apparatus as defined in either claim 1 or claim 2 wherein said second and fourth locations are at the same location along the length of said spreader bar.

4. Apparatus as defined in claim 1 wherein said first and second locations are at opposite ends of said spreader bar.

5. Apparatus as defined in claim 1 wherein said third and fourth locations are at opposite ends of said spreader bar.

6. Apparatus as defined in claim 1 wherein said first and second locations are equidistant from the longitudinal center of said spreader bar.

7. Apparatus as defined in claim 1 wherein said third and fourth locations are equidistant from the longitudinal center of said spreader bar.

8. Apparatus as defined in claim 1, additionally comprising:

a web interconnecting said pair of slings to form a cradle for supporting said sailboard, surfboard or the like.

9. Apparatus as defined in claim 8, wherein said web is formed of open-weave material.

10. Apparatus as defined in claim 1, wherein said spreader bar is a hollow tube, and wherein said strap passes through said hollow tube.

11. Apparatus as defined in claim 1 wherein said fastener comprises a hook-and-loop fastener.

12. Apparatus as defined in claim 11 additionally comprising:

a hook-and-loop fastener for adjusting the length of said shoulder harness.

13. A method of transporting a surfboard, sailboard or the like having ends, comprising:

encircling said surfboard, sailboard or the like with first and second slings each formed into a loop;

suspending said first and second loops from first and second locations spaced along the length of a rigid spreader bar;

suspending said spreader bar, and, thus in turn, said surfboard, sailboard or the like, from a strap passing over a shoulder of a person and attached at third and fourth locations on said spreader bar;

maintaining separation between said loops, along the length of said surfboard, sailboard or the like, by means of the separation between said first and second locations along said spreader bar, without attachment between said loops and said ends of said surfboard, sailboard or the like; and adjusting the length of said strap between said third and fourth locations to position said spreader bar in a location which permits said person to conveniently grasp said spreader bar while said strap is passed over said person's shoulder and to allow said person to guide said surfboard, sailboard or the like using said spreader bar as a handle.

14. A method as defined in claim 13, additionally comprising:

cradling said surfboard, sailboard or the like in a web attached to and suspended between said first and second loops.

15. A method as defined in claim 13, additionally comprising:

passing said strap along said spreader bar.

* * * * *